US007481425B2

(12) United States Patent
Chikumoto

(10) Patent No.: US 7,481,425 B2
(45) Date of Patent: Jan. 27, 2009

(54) PAPER FEED CASSETTE

(75) Inventor: Koichi Chikumoto, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 587 days.

(21) Appl. No.: 11/099,664

(22) Filed: Apr. 6, 2005

(65) Prior Publication Data

US 2005/0225025 A1 Oct. 13, 2005

(30) Foreign Application Priority Data

Apr. 13, 2004 (JP) ..... 2004-117983

(51) Int. Cl.
*B65H 1/22* (2006.01)

(52) U.S. Cl. ..... 271/164; 271/145; 271/162; 271/207

(58) Field of Classification Search ..... 271/145, 271/162–164, 9.11, 3.14, 207, 213; 399/393, 399/405; 400/624, 625; 378/182, 188; 396/517, 396/518, 525; 211/126.2, 126.6
See application file for complete search history.

(56) References Cited

U.S. PATENT DOCUMENTS

| | | | | |
|---|---|---|---|---|
| 4,525,063 | A * | 6/1985 | Eisbein | 355/72 |
| 5,145,166 | A * | 9/1992 | Neudecker et al. | 271/164 |
| 6,053,493 | A * | 4/2000 | Yokoyama et al. | 271/171 |
| 6,412,772 | B1 * | 7/2002 | Itoh et al. | 271/145 |
| 7,140,795 | B2 * | 11/2006 | Shiraishi et al. | 400/624 |
| 7,277,199 | B2 * | 10/2007 | Swayze et al. | 358/1.9 |
| 7,322,763 | B2 * | 1/2008 | Yang | 400/624 |
| 7,410,164 | B2 * | 8/2008 | Koide et al. | 271/213 |
| 2005/0052517 | A1 * | 3/2005 | Fujioka et al. | 347/104 |
| 2006/0263127 | A1 * | 11/2006 | Kim et al. | 399/393 |

FOREIGN PATENT DOCUMENTS

| | | | |
|---|---|---|---|
| JP | 59-167427 | A | 9/1984 |
| JP | 05-286579 | A | 11/1993 |
| JP | 06064761 | A * | 3/1994 |
| JP | 06-156757 | A | 6/1994 |
| JP | 06156757 | A * | 6/1994 |

* cited by examiner

*Primary Examiner*—Patrick H Mackey
*Assistant Examiner*—Jeremy Severson
(74) *Attorney, Agent, or Firm*—Global IP Counselors, LLP

(57) ABSTRACT

A paper feed cassette to be inserted into a paper feed port of an image-forming apparatus includes a bottom case, a top cover, a catch tray, and a connecting mechanism. The main case has a paper extraction port from which the pre-printed paper is fed to the paper feed port. The top cover slides relative to the main cover from a closed position to an open position to open the paper extraction port as the main case is inserted into the paper feed port. As the top cover slides toward the open position, the connecting mechanism pivots the catch tray from a flat position to a raised position. An upper surface of the catch tray and an upper surface of the cover member together form a bent-shaped printed paper receiving surface when the catch tray is in the raised position.

10 Claims, 3 Drawing Sheets

PRIOR ART

PAPER FEED CASSETTE

BACKGROUND OF THE INVENTION

1. Field of the Invention

The present invention relates to a paper feed cassette for stocking paper to be sent to the printing part of an image-forming apparatus. More particularly, the present invention relates to a paper feed cassette having a function as a catch tray for receiving paper ejected from the paper ejection port of the image-forming apparatus.

2. Background Information

FIG. 4(*a*) shows a schematic side view of an example of conventional paper feed cassette, and FIG. 4(*b*) shows the standby operation for such paper feed cassette.

In the example of conventional paper feed cassette shown in FIG. 4(*a*), a flat box-shaped cassette main body 1' for storing paper has a bottom case 2', a top cover 3', and a support shaft 21'. The back end portions of the bottom case 2' and top cover 3' are coupled to each other via the support shaft 21' that slidably engages a slot 31', which is formed on the side of the top cover 3' extending in the longitudinal direction of the top cover 3'. That way, the top cover 3' is capable of sliding in the longitudinal direction "a" relative to the bottom case 2'. When paper is to be loaded into the cassette main body 1', the top opening of the bottom cover 2' can be opened by pivoting the top cover 3' using the support shaft 21' as a fulcrum. After the paper is loaded, the top opening of the bottom cover 2' can be closed by pivoting the top cover 3' using the support shaft 21' as a fulcrum. When the top opening of the bottom cover 2' is closed with the top cover 3', a paper extraction port 12' having a specific width opens between the front end of the bottom cover 2' and the front end of the top cover 3', as shown in FIG. 4(*a*).

Also, the front end of an auxiliary cover 4', which functions as a catch tray in the longitudinal middle of the top cover 3', is mounted to the top cover 3' via a horizontal shaft 41' so as to be pivotable forward and backward as indicated by the arrow "b". The paper extraction port 12' closes when the auxiliary cover 4' is brought to a forward-tilted position, which his shown in the partially dotted line in FIG. 4(*a*). On the other hand, when the auxiliary cover 4' is brought to an inclined backward-tilted position as shown by the solid line in FIG. 4(*a*), a top surface 42', which is the inner surface of the auxiliary cover 4', extends backward from the middle of the top surface portion 32' of the top cover 3', whereby a bent-shaped paper-receiving surface 5' is formed by both of the top surfaces 42' and 32'. The backward inclination of the auxiliary cover 4 is restricted by a part of the auxiliary tray 4' coming into contact with the top cover 3'.

With the auxiliary cover 4' in the backward-tilted position as shown in the solid line, the paper feed cassette is installed in the paper feed port 110' of a printer or another such image-forming apparatus 100' by inserting the front end of the cassette main body 1' into the paper feed port 110', in the direction shown by the arrow "a". After the paper extracted from the paper extraction port 12' is printed on by the operation of the image-forming apparatus in which the paper feed cassette is installed, the paper is ejected from a paper ejection port (not shown) of the image-forming apparatus 100' onto the paper-receiving surface 5' in the direction shown as arrow "c" in FIG. 4(*b*).

As is shown in FIG. 4(*b*), the paper P ejected from the paper ejection port of the image-forming apparatus 100' onto the paper-receiving surface 5' is held by the paper-receiving surface 5' such that a portion around the area "D" is raised due to the rigidity of the paper P from the bent portion between the top surfaces 32' and 42'. Accordingly, the paper P ejected onto the paper-receiving surface 5' can be easily retrieved using the gap S formed between the paper-receiving surface 5' and the paper P in the area D. In FIG. 4(*b*), θ indicates the angle formed between the top surface 32' of the top cover 3' and the top surface 42' of the auxiliary cover 4'.

In the conventional examples described in FIG. 4, the auxiliary cover 4' must be brought to a backward-tilted position as shown by the solid line in FIG. 4(*a*) to open the paper extraction port 12' before the paper feed cassette is installed in the paper feed port 110' of the image-forming apparatus 100'. Also, if the auxiliary cover 4' is left in the backward-tilted position shown by the solid line in FIG. 4(*a*) after the paper feed cassette is removed from the image-forming apparatus, the paper extraction port 12' stays open and dust adheres to the paper stored therein and soils the paper surface. This dust may cause printing quality deterioration or paper jams during the next printing cycle. Particularly, when the image-forming apparatus is a dye sublimation printer, glossy papers are often stocked in the paper feed cassette for high-quality printing. Therefore, it is extremely important to prevent soiling of the paper surface due to dust that enters onto the paper surface from the paper extraction port 12'. In order to prevent such soiling, the paper extraction port 12' must be closed by pivoting the auxiliary cover 4' so that dust does not adhere to the paper surface in the paper feed cassette after the paper feed cassette is removed from the paper feed portion 110' of the image-forming apparatus 100'.

Therefore, as previously described, although the above-mentioned example of conventional paper feed cassette is meritorious in that the paper P ejected onto the paper-receiving surface 5' is easily retrieved by utilizing the gap S formed above the bent portion of the paper-receiving surface 5', the above-mentioned paper feed cassette also has problems in that the auxiliary cover 4' must be tilted backward to the backward-tilted position to open the paper extraction port 12' every time the paper feed cassette is to be installed in the paper feed port 110' of the image-forming apparatus 100'. Similarly, the auxiliary cover 4' must be tilted forward to close the paper extraction port 12' every time the paper feed cassette is removed from the paper feed port 110'.

As an example of other conventional catch tray, it has been proposed in Japanese Patent Application Publication No. 59-167427 to provide a paper feed cassette feed for a copy machine in which the cover of the paper feed cassette is constantly biased in the closing direction, and when the cassette is installed in the copy machine the cover of the paper feed cassette as well as the paper feed port (paper extraction port) open. In another example, Japanese Patent Application Publication No. 6-156757 provides an image-forming apparatus which has a catch tray that is designed to close the top surface of a paper feed cassette as the paper feed cassette is inserted into the paper feed port of the image-forming apparatus. In still another example, Japanese Patent Application Publication No. 5-286579 discloses a paper feed cassette of which the top cover is installed in an image-forming apparatus and opened by the power from a motor installed also in the image-forming apparatus. In these examples, the cover described in Japanese Patent Application Publication No. 59-167427, the catch tray described in Japanese Patent Application Publication No. 6-156757, and the top cover described in Japanese Patent Application Publication No. 5-286579 all function as a catch tray.

The paper feed cassettes disclosed in Japanese Patent Application Publication Nos. 59-167427 and 5-286579 are both provided with functions of preventing dust from adhering to the surface of the paper stocked in the paper feed cassette by the cover or top cover. However, the paper-receiving surfaces defined by the top surface of the cover or top cover described above) are both formed to be flat. Therefore, these structures do not allow easy retrieval of the paper ejected onto the paper receiving surface, unlike the structure described above and shown in FIG. 4. More specifically, although the paper feed cassette shown in FIG. 4 allows the paper P ejected onto the paper-receiving surface 5 to be easily retrieved due to the gap S formed between the bent paper-receiving surface 5 and the paper P, the paper feed cassettes of Japanese Patent Application Publication Nos. 59-167427 and 5-286579 do not allow such easy retrieval of the paper because the paper-receiving surface is formed in a flat shape. The same problem also applies to the structure disclosed in Japanese Patent Application Publication No. 6-156757.

In view of the above, it will be apparent to those skilled in the art from this disclosure that there exists a need for an improved paper feed cassette that overcomes the problems of the conventional art. This invention addresses this need in the art as well as other needs, which will become apparent to those skilled in the art from this disclosure.

SUMMARY OF THE INVENTION

It is an object the present invention to provide a paper feed cassette for an image-forming apparatus that allows easy retrieval of printed paper and easy attachment to the image-forming apparatus with a simple structure.

The paper feed cassette for an image-forming apparatus in accordance with a first aspect of the present invention is adapted to be inserted into a paper feed port of an image-forming apparatus for feeding pre-printing paper to the image-forming apparatus and receiving printed paper from the image-forming apparatus. The paper feed cassette includes a main case, a cover member, a catch tray, and a connecting mechanism. The main case is adapted to hold pre-printed paper. A front end portion of the main case is adapted to be inserted into the paper feed port. The main case has a paper extraction port from which the pre-printed paper is adapted to be fed to the paper feed port. The cover member is coupled to the main case so as to be slidable from a closed position to an open position in a direction parallel to the insertion direction of the main case. The cover member covers the paper extraction port when the cover member is in the closed position, and exposes the paper extraction port when the cover member is in the open position. The cover member slides from the closed position to the open position as the paper feed cassette is inserted into the paper feed port. The catch tray is supported on the cover member so as to be pivotable between a flat position and a raised position. An upper surface of the catch tray and an upper surface of the cover member together form a bent-shaped printed paper receiving surface when the catch tray is in the raised position. The connecting mechanism is coupled to the catch tray and the cover member. The connecting mechanism pivots the catch tray from the flat position to the raised position as the cover member slides from the closed position to the open position.

With this configuration, the paper extraction port opens in conjunction with the insertion of the main case into the paper feed port of the image-forming apparatus, and the catch tray is raised to the raised position to form the bent-shaped paper-receiving surface. Therefore, even if the paper extraction port is closed by the cover member when the main case is removed from the image-forming apparatus, there is no need for the user to manually open the paper extraction port by sliding the cover member before inserting the main case into the paper feed port of the image-forming apparatus.

In the present invention, the connecting mechanism preferably has a link member, a first support shaft rotatably coupled to the main case, and a second support shaft rotatably coupled to the of the catch tray, the link member being relatively unrotatably coupled with the first and second support shafts. Therefore, the paper feed cassette can be formed in a simple structure.

In the present invention, the cover member has a slot that extends in the insertion direction of the main case, and the first support shaft of the connecting mechanism is preferably inserted in the slot of the cover member so as to be slidable in the insertion direction. In this manner, the sliding operation of the cover member can be utilized in the pivoting operation via the first support shaft.

In the present invention, the paper feed cassette preferably further includes a release prevention mechanism provided in the main case and the cover member to secure the cover member in the closed position unless the cover member is slid toward the open position with a force greater than a predetermined force. Thus, it is possible to forestall problems wherein the top cover closing the paper extraction port inadvertently opens and dust enters from the paper extraction port.

In the present invention, the release prevention mechanism preferably includes an interlocking protrusion that is elastically supported on one of the main case and the cover member, and an interlocking hole formed on the other of the main case and the cover member in which the interlocking protrusion engages when the cover member is in the closed position. Thus, the release prevention mechanism can be formed inexpensively without having increase the number of part from which the release prevention mechanism is to be formed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 1(*b*) is a schematic side view of the paper feed cassette in accordance with the embodiment of the present invention, where the paper extraction port is open;

FIG. 4(*b*) is a diagram showing the standby operation of the conventional paper feed cassette shown in FIG. 4(*a*).

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
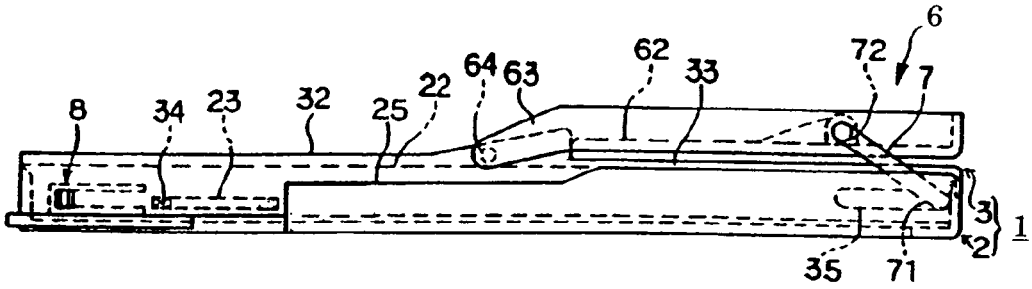
FIG. 1(*a* is a schematic side view of a paper feed cassette in accordance with the embodiment of the present invention, where the paper extraction port is closed.
Figure 1:
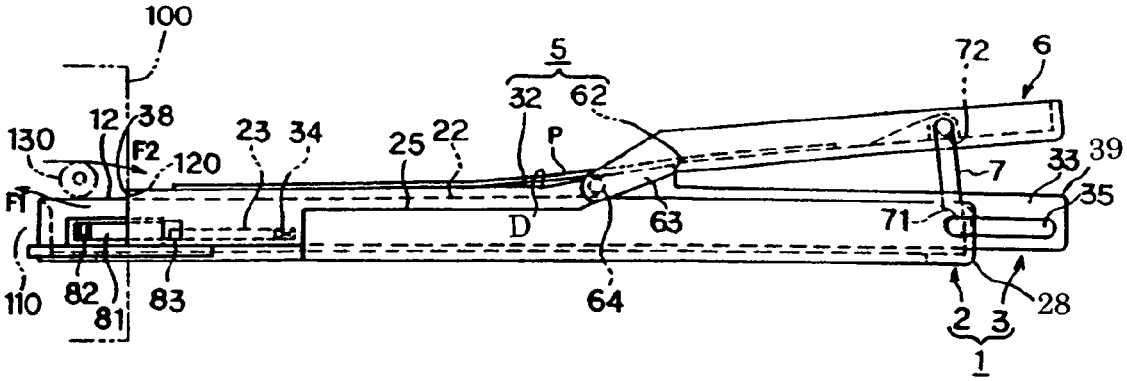
Figure 2:
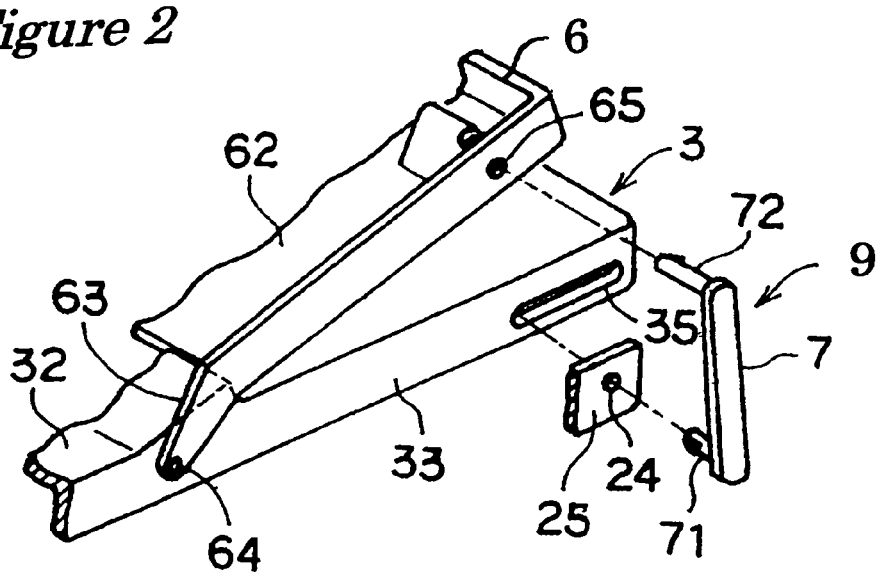
FIG. 2 is an exploded partial perspective view of the paper feed cassette in accordance with the embodiment of the present invention, showing the connecting mechanism.

FIG. 1(*a*) is a schematic side view showing a paper feed cassette in accordance with the embodiment of the present invention in a state wherein the paper extraction port 12 is closed, and FIG. 1(*b*) is a schematic side view showing the same paper feed cassette in a state wherein the paper extraction port 12 is open. FIG. 2 is a partial exploded perspective view of the connecting mechanism of the paper feed cassette, and FIG. 3 is a partial exploded perspective view of release prevention mechanism of the same paper feed cassette.

Figure 4:
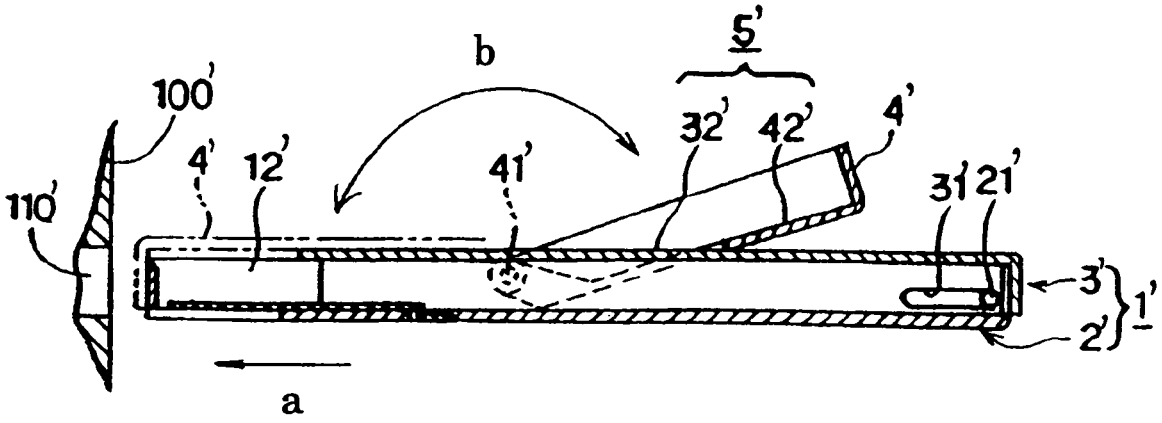
FIG. 4(*a*) is a schematic side view of a conventional paper feed cassette.
Figure 4:
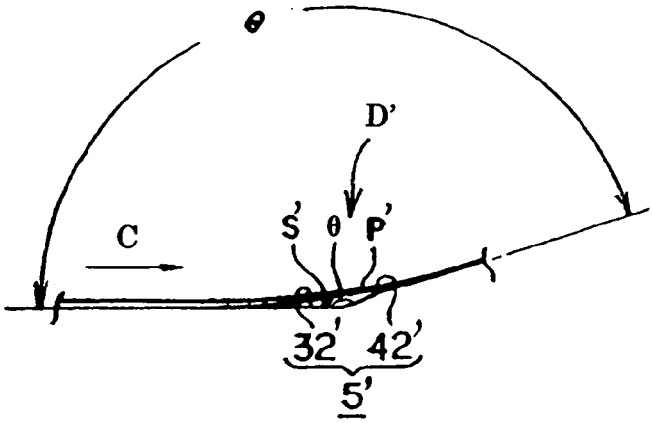
PRIOR ART Figure 4 (b)

A paper feed cassette in accordance with the present embodiment includes a cassette main body 1, a catch tray 6, a connecting mechanism 9, and a release prevention mechanism 8. In this paper feed cassette, the cassette main body 1 for storing paper has a bottom case 2 and a top cover 3 that covers a top opening of the bottom case 2, similar to the conventional paper feed cassette shown in FIG. 4. In the paper feed cassette according to the present invention. However, the catch tray 6 is attached to the cassette main body 1 instead of the auxiliary cover 4' as in FIG. 4. With the cassette main body 1 inserted and installed in the paper feed port 110 of the image-forming apparatus 100, a paper-receiving surface 5 is formed by a top surface portion 32 of the top cover 3 and a top surface 62 of the catch tray 6 extends backward.

Figure 3:
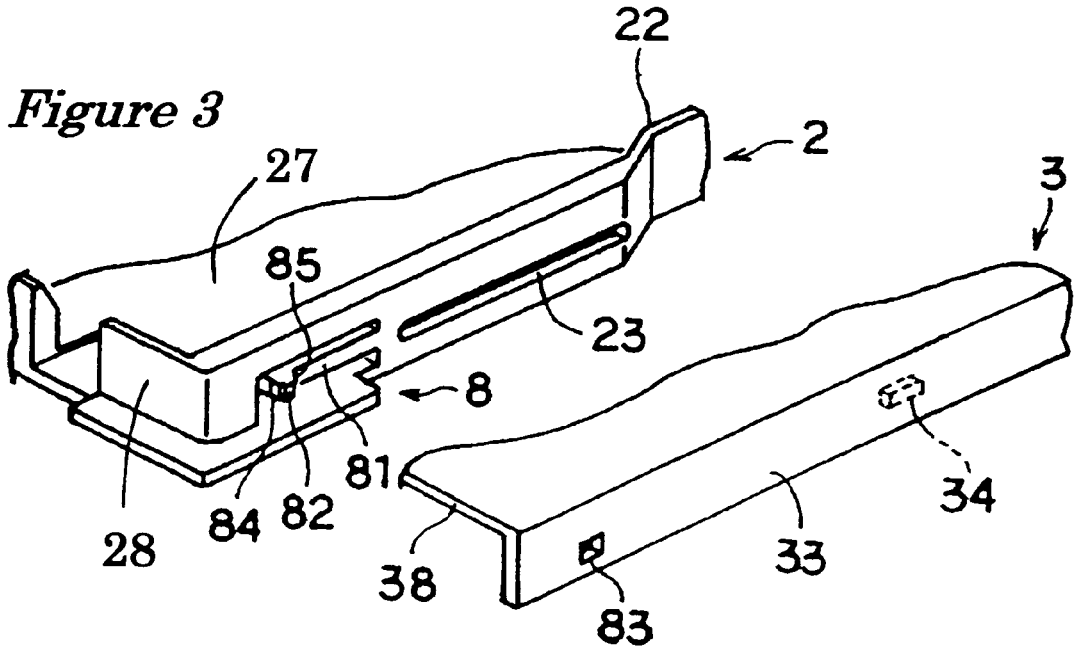
FIG. 3 is an exploded partial perspective view of the same paper feed cassette in accordance with the embodiment of the present invention, showing the release prevention mechanism.

As can be seen in FIGS. 1 through 3, the bottom case 2 has side walls 22 that extend in the longitudinal direction of the bottom case 2, a bottom surface 27 onto which pre-printed paper to be stored is placed, and front and rear walls 28 that are positioned at front and rear of the bottom surface 27. As seen in FIG. 3, width between the side walls 22 is wider in the front portion of the bottom case 2 than in the rear portion of the bottom case 2. An area enclosed by the side walls 22 and the front and rear walls 28 define a top opening of the bottom case 2. In this embodiment, the left to right direction as viewed in FIG. 1 is referred to as the longitudinal direction, which is also the insertion direction of the paper feed cassette, while the direction perpendicular to the paper plane of FIG. 1 is referred to as the width direction. However, it should not be construed that the paper feed cassette of the present invention is necessarily longer in size in the longitudinal direction. The paper feed cassette of the present invention can be longer in size in the width direction than in the longitudinal direction.

The bottom case 2 also includes upright walls 25 that are positioned adjacent to and at a distance from a rear half of the outside of the side walls 22. The upright walls 25 are integrally formed at the width direction ends of the bottom surface 27. Accordingly, the top cover 3 is sized to be wide enough to cover the entire top opening of the bottom case 2, but narrow enough such that each of side walls 33 to be described below is positioned between the side wall 22 and the upright wall 25. As described below, the side walls 33 of the top cover 3 slide through a gap between the side walls 22 and the upright walls 25 when the top cover 3 is slid frontward and rearward relative to the bottom case 2. The bottom case 2 also has slits 23 that are formed on the front portions of the side walls 22 so as to extend in the longitudinal direction, as shown in FIG. 3. In addition, as shown in FIGS. 1 and 2, each of the upright wall 25 includes a shaft hole 24, through which a bottom support shaft 71 of the connecting mechanism 9 to be described later is inserted.

As shown in FIGS. 2 and 3, the top cover 3 includes a top surface portion 32, side walls 33, and a rear wall 39. Slots 35 are formed on the rear portion of the side walls 33 so as to extend in the longitudinal direction of the top cover 3. The bottom support shafts 71 of the connecting mechanism 9 are inserted into the slots 35 via the shaft holes 24 of the upright walls 25, such that the bottom support shafts 71 are slidable relative to the slots 35.

Further as shown in FIG. 3, interlocking protrusions 34 facing inward are provided to the side walls 33 of the top cover 3, such that the interlocking protrusions 34 engage the slots 23 in a longitudinally slidable manner as shown in FIG. 1. A wide space is maintained between the position at which the interlocking protrusion 34 and slot 23 engage and the position at which the bottom support shaft 71 and slot 35 engage. The bottom support shafts 71 and the slots 35 engage with the shaft holes 24, which are positioned at the rear end of the upright walls 25 of the bottom case 2. As a result of this configuration, the top cover 3 is slidably guided in the longitudinal direction relative to the bottom case 2 by the engagement between the interlocking protrusions 34 and the slots 23 and the engagement between the bottom support shafts 71 and the slots 35. FIG. 1(*a*) shows the state where the top cover 3 is closed, with the protrusions 34 and the bottom support shafts 71 respectively engaging the slots 23 and the slots 35 at their front most ends. FIG. 1(*b*) shows the state where the top cover 3 is opened, with the protrusions 34 and the bottom support shafts 71 respectively engaging the slots 23 and the slots 35 at their rear most ends. In this manner, the top cover 3 is mounted to the bottom case 2 without being easily disengaged from the bottom case 2.

As shown in FIG. 3, the release prevention mechanism 8 is located between the bottom case 2 and the top cover 3 on each of the left and right side. This release prevention mechanism 8 includes an elastic portion 81, an interlocking protrusion 82, and an interlocking hole 83. The elastic portion 81 is provided in the bottom case 2 extending forward in a cantilevered fashion with an interlocking protrusion 82 in the free end. The tip of the interlocking protrusion 82 is protruding outward in the width direction from the side surface of the elastic portion 81. Slanted guiding surfaces 84, 85 are provided to the front and rear of the interlocking protrusion 82. The interlocking hole 83 is provided on the side wall 33 of the top cover 3, such that the interlocking protrusion 82 engages the interlocking hole 83. When the top cover 3 slides to the forward position to close the paper extraction port 12 as shown in FIG. 1(*a*), the interlocking protrusion 82 protrudes into and engages the interlocking hole 83, and the top cover 3 is secured at the forward position relative to the bottom case 2. Therefore, the top cover 3 does not slide rearward inadvertently, and the paper stored in the cassette main body 1 can be prevented from being soiled by dust entering from the paper extraction port 12. Also, if the top cover 3 is pushed backward from the forward position with a force greater than a certain amount of force, the edge of the interlocking hole 83 catches on the slanted guiding surface 84 of the interlocking protrusion 82 while bending the elastic portion 81. Therefore, the secured state described above is released and the top cover 3 slides rearward relative to the bottom cover 2. Conversely, when the top cover 3 is shifted frontward to close the paper extraction port 12, the front edge of the side wall 33 first contacts the sliding surface 85. As the elastic portion 81 bends inward, the top cover 3 is allowed to slide forward relative to the bottom case 2, until the tip of the interlocking protrusion 82 engages the interlocking hold 83, thereby securing the top cover 3 in the front position.

Although both of the slanted guiding surfaces 84 and 85 are provided on the interlocking protrusion 82 in this embodiment, the present invention is not limited to this construction. The slanted guiding surfaces can be provided to either of the interlocking protrusion 82 and the interlocking hole 83.

The catch tray 6 has a top surface 62, a side wall 66, and extension portions 63 that are formed on width-direction ends of the top surface 62. The side wall 66 is unitarily formed with the top surface 62 on the left, right, and rear edges of the top surface 62. The extension portions 63 are provided to the front ends of the side wall 66 and mounted to the side wall 33 of the top cover 3 via horizontal shafts 64. The horizontal shafts 64 are coupled to the side walls 33 of the top cover 3 at their approximately longitudinally middle positions, as shown in FIGS. 1 and 2. The catch tray 6 is capable of pivoting vertically using the horizontal shafts 64 as a fulcrum.

The rear end of the catch tray 6 is linked to the bottom case 2 by a connecting mechanism 9. The connecting mechanism 9 includes a coupling link member 7, the bottom support shaft 71 and a top support shaft 72. The coupling link member 7 is formed integrally with the upper and bottom support shafts 71 and 72. The bottom support shaft 71 is rotatably inserted into the shaft hole 24 formed in the upright wall 25 of the bottom case 2. The top support shaft 72 is rotatably inserted into a shaft hole 65 formed in a rear end portion of the catch tray 6. The coupling link member 7 is arranged such that its rear end is positioned at a lower position relative to its front end. With such a configuration for the connecting mechanism 9, when the top cover 3 slides rearward relative to the bottom case 2 from the forward position, the top support shaft 72 of the connecting mechanism 9 inserted through the shaft hole 65 of the catch tray 6 is also pivoted rearward as the bottom case 2 is pushed rearward. Accordingly, the front end of the coupling link member 7 is pivoted upward as shown in FIG. 1(*b*), using as a fulcrum the bottom support shaft 71 of the connecting mechanism 9, which is inserted into the shaft hole 24 formed in the upright wall 25 of the bottom case 2. As a result, the catch tray 6 is pivoted upward and reaches the rear-raised position.

When the catch tray 6 thus reaches the rear-raised position, the top surface 62 of the catch tray 6 and the top surface portion 32 on the front half of the top cover 3 together form a bent-shaped paper-receiving surface 5. Also, when the top cover 3 slides forward relative to the bottom case 2, the top support shaft 72 of the connecting mechanism 9 inserted into the shaft hole 65 of the catch tray 6 is also pulled forward in conjunction with the forward movement of the top cover 3. Therefore, the coupling link member 7 is pivoted downward as shown in FIG. 1(*a*), using as a fulcrum the bottom support shaft 71 of the connecting mechanism 9 inserted into the shaft hole 24 in the upright wall 25 of the bottom case 2. The catch tray 6 accordingly reaches a storage position overlapping the top cover 3.

As described above, when the paper feed tray is removed from the image-forming apparatus, the top cover 3 can be brought to the forward position to close the paper extraction port 12 as shown in FIG. 1. Therefore, dust is unlikely to enter the interior of the cassette main body 1 from the paper extraction port 12, and the paper stored in the interior is therefore not likely to be soiled by the dust entering from the paper extraction port 12.

When the paper extraction port 12 is closed by the top cover 3 as the cassette main body 1 is inserted into the paper feed port 110 of the image-forming apparatus 100, an interlocking part 38, which is the front edge of the top cover 3, engages a stopper part 120 (FIG. 1(*b*)) provided at the top side of the paper feed port 110. As the bottom case 2 is inserted further into the paper feed port 110, the top cover 3 slides rearward relative to the bottom case 2 inserted through the paper feed port 110, and the paper extraction port 12 opens in the front end of the cassette main body 1. Also, due to the operation of the connecting mechanism 9, the catch tray 6 rises from the storage position to the rear-raised position as the top cover 3 slides rearward relative to the bottom case 2. Accordingly, the bent-shaped paper-receiving surface 5 is formed by the top surface portion 32 of the top cover 3 and the top surface 62 of the catch tray 6.

Therefore, when a roller 130 that serves both as a pickup roller and a paper ejecting roller and is provided to the image-forming apparatus 100 rotates in a predetermined paper pickup direction, paper is extracted from the paper extraction port 12 of the cassette main body 1, as shown by the arrow F1 in FIG. 1(*b*), and the paper is sent to the printing part. The printed paper P is then ejected from the paper ejection port (not shown) of the image-forming apparatus 100 onto the paper-receiving surface 5, as shown by the arrow F2. The paper P thus ejected onto the paper-receiving surface 5 is kept in a state in which the portion of the paper is raised from the bent portion of the paper-receiving surface 5 around the area D. Therefore, the paper P can be easily retrieved by utilizing the space S between the paper P and the paper-receiving surface 5.

In this embodiment, the configuration of the connecting mechanism 9 has a simplified structure by forming the coupling link member 7 integrally with the upper and bottom shafts 71 and 72. A configuration other than one that uses the coupling link member 7 can also be employed for the connecting mechanism 9.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

As described above, the paper feed cassette in accordance with the present invention allows the paper ejected from the paper ejection port of the image-forming apparatus to be received by a bent-shaped paper-receiving surface, such that the paper can be easily retrieved from the paper-receiving surface.

Moreover, the paper extraction port opens automatically as the cassette main body is installed in the paper feed port. Thus, there is no need to separately open the paper extraction port when installing the cassette main body in the paper feed port. Furthermore, once the top cover is shifted forward to close the paper extraction port, the top cover is secured in the closed position. Therefore, this paper feed cassette is particularly suitable for use with glossy papers for a dye sublimation printer, since the paper extraction port keeps the glossy paper in the paper feed cassette from being soiled with dust. In addition, the paper feed cassette of the present invention can provide such advantages with an extremely simple configuration.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2004-117983. The entire disclosure of Japanese Patent Application No. 2004-117983 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A paper feed cassette adapted to be inserted into a paper feed port of an image-forming apparatus for feeding pre-printing paper to the image-forming apparatus and receiving printed paper from the image-forming apparatus, the paper feed cassette comprising:

a main case adapted to hold pre-printed paper, a front end portion of the main case being adapted to be inserted into the paper feed port, the main case having a paper extraction port from which the pre-printed paper is adapted to be fed to the paper feed port;

a cover member slidably coupled to the main case so as to be slidable relative to the main case from a closed position to an open position in a direction parallel to the insertion direction of the main case, the cover member covering the paper extraction port when the cover member is in the closed position, and exposing the paper extraction port when the cover member is in the open position, the cover member sliding from the closed position to the open position as the paper feed cassette is inserted into the paper feed port;

a catch tray supported on the cover member so as to be pivotable between a flat position and a raised position, an upper surface of the catch tray and an upper surface of the cover member together forming a bent-shaped printed paper receiving surface when the catch tray is in the raised position; and a connecting mechanism that is coupled to the catch tray and the cover member, the connecting mechanism pivoting the catch tray from the flat position to the raised position as the cover member slides from the closed position to the open position.

2. The paper feed cassette for an image-forming apparatus according to claim 1, further comprising a release prevention mechanism provided in the main case and the cover member to secure the cover member in the closed position unless the cover member is slid toward the open position with a force greater than a predetermined force.

3. The paper feed cassette for an image-forming apparatus according to claim 1, wherein the front end portion of the main case is adapted to engage an edge portion of the paper feed port, wherein the cover member is adapted to be slid from the closed position toward the open position by the edge portion of the paper feed port as the main case is inserted into the paper feed port.

4. A paper feed cassette adapted to be inserted into a paper feed port of an image-forming apparatus for feeding pre-printing paper to the image-forming apparatus and receiving printed paper from the image-forming apparatus, the paper feed cassette comprising:

a main case adapted to hold pre-printed paper, a front end portion of the main case being adapted to be inserted into the paper feed port, the main case having a paper extraction port from which the pre-printed paper is adapted to be fed to the paper feed port;

a cover member coupled to the main case so as to be slidable from a closed position to an open position in a direction parallel to the insertion direction of the main case, the cover member covering the paper extraction port when the cover member is in the closed position, and exposing the paper extraction port when the cover member is in the open position, the cover member sliding from the closed position to the open position as the paper feed cassette is inserted into the paper feed port;

a catch tray supported on the cover member so as to be pivotable between a flat position and a raised position, an upper surface of the catch tray and an upper surface of the cover member together forming a bent-shaped printed paper receiving surface when the catch tray is in the raised position; and a connecting mechanism that is coupled to the catch tray and the cover member, the connecting mechanism pivoting the catch tray from the flat position to the raised position as the cover member slides from the closed position to the open position, the connecting mechanism having a link member, a first support shaft rotatably coupled to the main case, and a second support shaft rotatably coupled to the catch tray, the link member being relatively unrotatably coupled with the first and second support shafts.

5. The paper feed cassette for an image-forming apparatus according to claim 4, wherein the cover member has a slot that extends in the insertion direction of the main case, and the first support shaft of the connecting mechanism is inserted in the slot of the cover member so as to be slidable in the insertion direction.

6. A paper feed cassette adapted to be inserted into a paper feed port of an image-forming apparatus for feeding pre-printing paper to the image-forming apparatus and receiving printed paper from the image-forming apparatus, the paper feed cassette comprising:

a main case adapted to hold pre-printed paper, a front end portion of the main case being adapted to be inserted into the paper feed port, the main case having a paper extraction port from which the pre-printed paper is adapted to be fed to the paper feed port;

a cover member coupled to the main case so as to be slidable from a closed position to an open position in a direction parallel to the insertion direction of the main case, the cover member covering the paper extraction port when the cover member is in the closed position, and exposing the paper extraction port when the cover member is in the open position, the cover member sliding from the closed position to the open position as the paper feed cassette is inserted into the paper feed port;

a catch tray supported on the cover member so as to be pivotable between a flat position and a raised position, an upper surface of the catch tray and an upper surface of the cover member together forming a bent-shaped printed paper receiving surface when the catch tray is in the raised position;

a connecting mechanism that is coupled to the catch tray and the cover member, the connecting mechanism pivoting the catch tray from the flat position to the raised position as the cover member slides from the closed position to the open position; and a release prevention mechanism provided in the main case and the cover member to secure the cover member in the closed position unless the cover member is slid toward the open position with a force greater than a predetermined force, the release prevention mechanism including an interlocking protrusion that is elastically supported on one of the main case and the cover member, and an interlocking hole formed on the other of the main case and the cover member in which the interlocking protrusion engages when the cover member is in the closed position.

7. A paper feed cassette adapted to be inserted into a paper feed port of an image-forming apparatus for feeding pre-printing paper to the image-forming apparatus and receiving printed paper from the image-forming apparatus, the paper feed cassette comprising:

a main case adapted to hold pre-printed paper, a front end portion of the main case being adapted to be inserted into the paper feed port, the main case having a paper extraction port from which the pre-printed paper is adapted to be fed to the paper feed port;

a cover member having sliding means for sliding the cover member relative to the main case in a direction parallel to an insertion direction of the main case from a closed position to an open position, the cover member covering the paper extraction port when the cover member is in the closed position, and exposing the paper extraction port when the top cover is in the open position, the sliding means sliding the cover member from the closed position to the open position as the paper feed cassette is inserted into the paper feed port;

a catch tray supported on the cover member so as to be pivotable between a flat position and a raised position, an upper surface of the catch tray and an upper surface of the cover member together forming a bent-shaped printed paper receiving surface when the catch tray is in the raised position; and connecting means for pivoting the catch tray from the flat position to the raised position as the sliding means slides the cover member from the closed position to the open position.

8. The paper feed cassette for an image-forming apparatus according to claim 7, wherein the connecting means causes pivoting of the catch tray between the flat position and the raised position with the sliding of the cover member.

9. The paper feed cassette for an image-forming apparatus according to claim 7, further comprising release prevention means for securing the cover member in the closed position unless the cover member is slid toward the open position with a force greater than a predetermined force.

10. The paper feed cassette for an image-forming apparatus according to claim 7, wherein the sliding means slides the cover member from the closed position to the open position by engagement of an edge portion of the paper feed port and an insertion direction end portion of the cover member.

* * * * *